United States Patent [19]

Randall

[11] 4,126,805

[45] Nov. 21, 1978

[54] X-RAY TUBES

[75] Inventor: Robert P. Randall, Uxbridge, England

[73] Assignee: EMI Limited, Hayes, England

[21] Appl. No.: 731,428

[22] Filed: Oct. 12, 1976

[30] Foreign Application Priority Data

Oct. 18, 1975 [GB] United Kingdom ..... 42865/75
Oct. 22, 1975 [GB] United Kingdom ..... 43447/75

[51] Int. Cl.[2] ..... H01J 35/00
[52] U.S. Cl. ..... 313/57; 313/55; 313/346 R
[58] Field of Search ..... 313/57, 55, 346 R

[56] References Cited

U.S. PATENT DOCUMENTS 2,362,816 11/1944 Harker ..... 313/57
3,046,430 7/1962 Green ..... 313/57

*Primary Examiner*—Rudolph V. Rolinec
*Assistant Examiner*—Darwin R. Hostetter
*Attorney, Agent, or Firm*—Cooper, Dunham, Clark, Griffin & Moran

[57] ABSTRACT

An X-ray tube is described in which, in order to produce a well defined electron beam which can be accurately focussed on the target of the tube, the cathode comprises a flat plate member, such as a tape or foil, the surface finish of which is sufficiently smooth that electrons are emitted therefrom with lateral energies below 0.2 electron volts. The aforementioned surface finish is such that irregularities in the electron-emitting surface of the cathode do not exceed one micron in amplitude.

13 Claims, 7 Drawing Figures

X-RAY TUBES

This invention relates to X-ray tubes and to electron sources for such tubes.

In some circumstances, for example when an X-ray tube is to be used in a computerised tomographic apparatus, it is desirable that the electron source provides a dense electron beam which nevertheless is substantially free of aberrations and can be finely and accurately focussed on the X-ray emitting target of the tube. This is particularly the case when the computerised tomographic appartus concerned is of the kind described and claimed in U.S. patent application Ser. No. 630,779, now U.S. Pat. No. 4,010,370 which requires a scanned source of X-rays, the scanning being produced by electromagnetic deflection of the electron beam.

It is an object of this invention to provide an X-ray tube in which the density of electron emission from the cathode thereof is high (e.g. of the order of $0.5A/cm^2$ or greater) but wherein the electrons form a beam substantially free of aberration which can be finely and accurately focussed on the X-ray emitting target of the tube.

According to the invention there is provided an X-ray tube having a cathode comprising a flat or dished plate member formed so that irregularities in the electron-emitting surface thereof do not exceed one micron in amplitude, means for generating an extraction field for withdrawing electrons from said member in substantially a single direction, an X-ray emissive target member, and means for focussing said electrons on a region of said target member which is of area substantially less than the area of said plate member.

Figure 1:
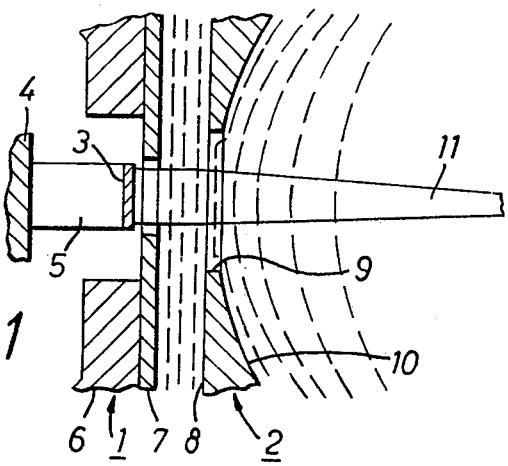
Figure 2:
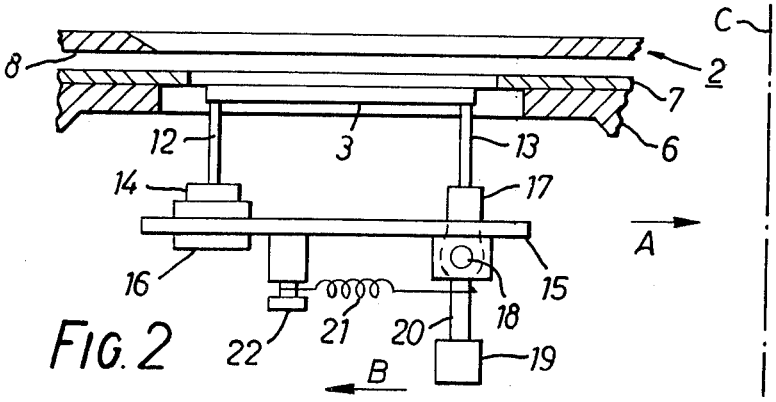
Figure 5:
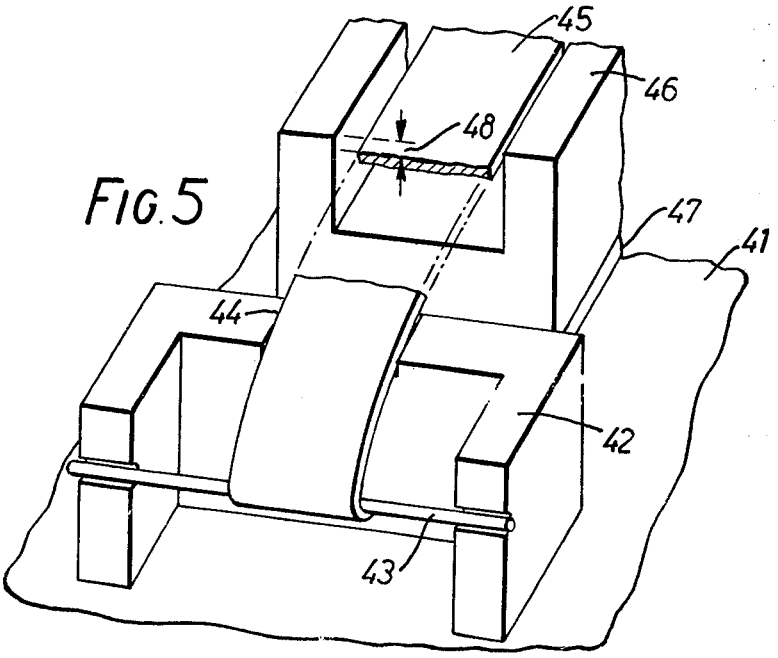
Figure 3A:
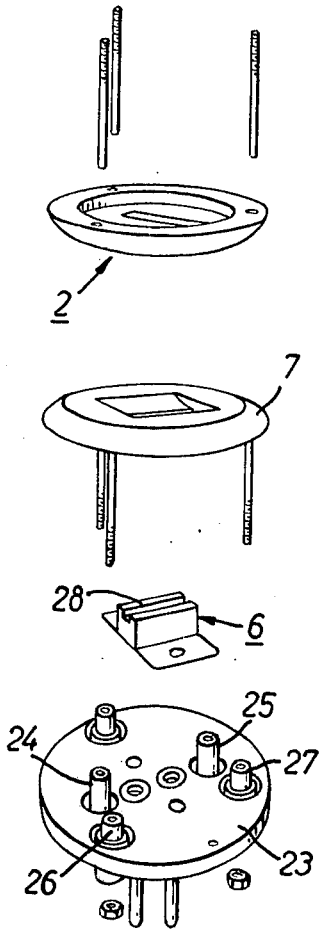
Figure 3B:
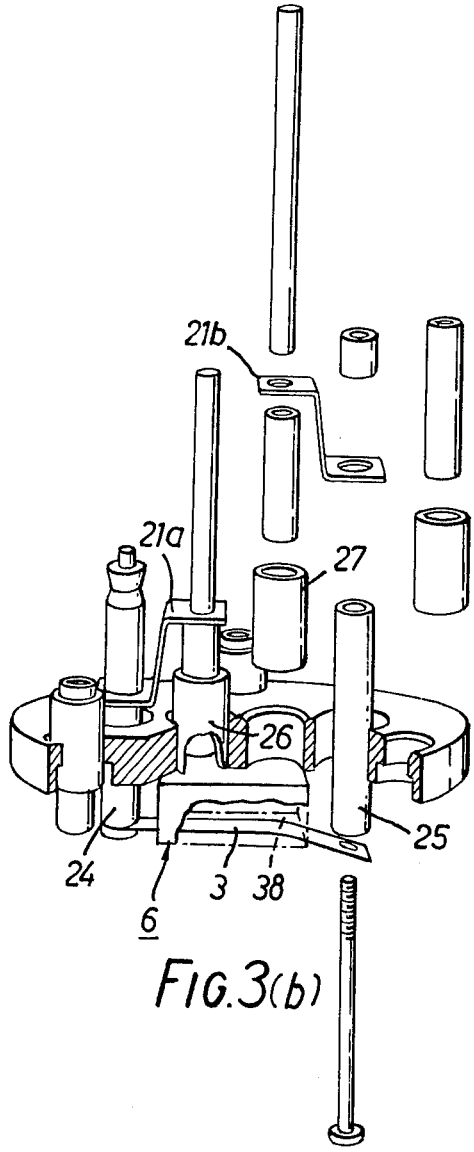
Figure 3C:
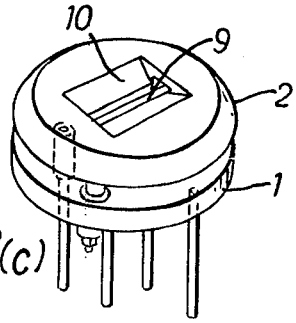
Figure 4:
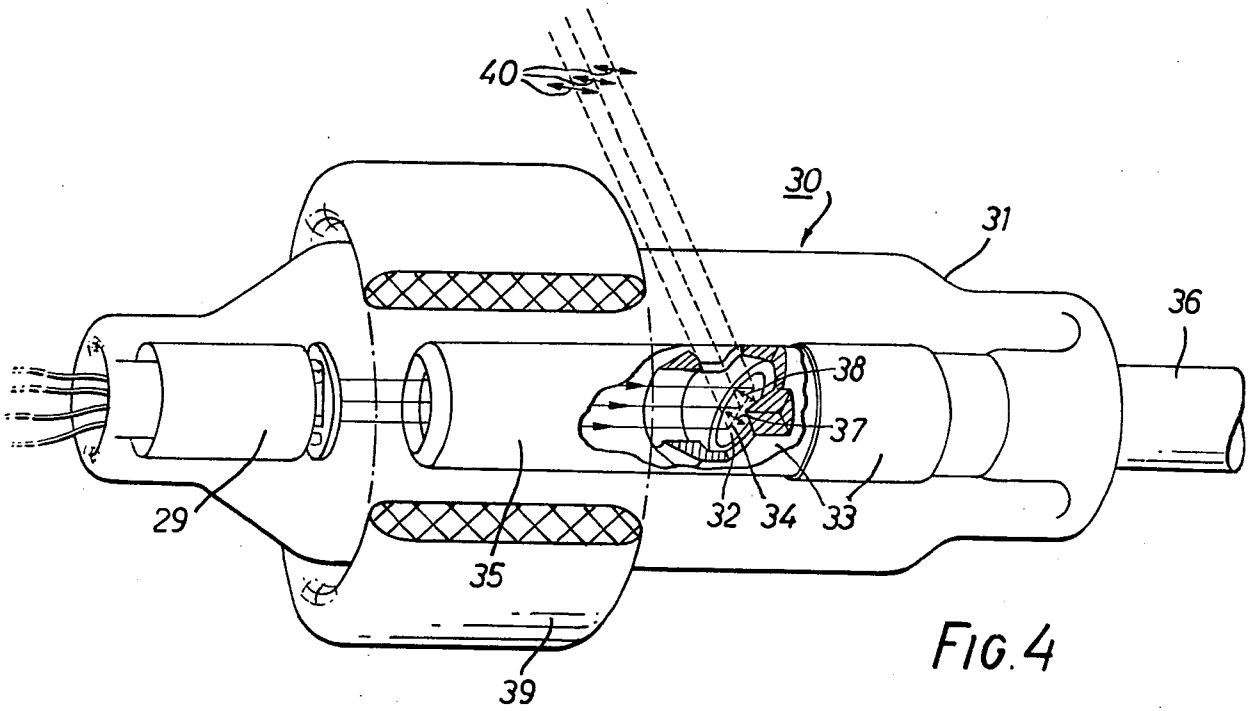

In order that the invention may be clearly understood and readily carried into effect, one embodiment thereof will now be described, by way of example only, with reference to the accompanying drawings of which:

FIG. 1 shows a cross-sectional view of a cathode suitable for use in a tube according to one example of the invention, FIG. 2 shows a longitudinal view of a cathode of the kind shown in FIG. 1, together with an assembly for mounting said cathode, FIG. 3 comprises FIGS. 3(*a*), 3(*b*) and 3(*c*) which show respective views of the structure of a cathode of the same general kind as that shown in FIG. 1, FIG. 4 shows, in isometric view, an X-ray tube in accordance with an example of the invention, and FIG. 5 shows a suitable arrangement for constructing a cathode.

Referring now to the drawings, FIG. 1 shows a cross-sectional view of a cathode suitable for use in a tube in accordance with one example of the invention.

The cathode assembly is indicated generally at 1 and a grid electrode structure at 2. An X-ray emitting anode and the other parts necessary for an X-ray tube are not shown but will be readily apparent to those skilled in the art.

The cathode assembly includes a tape or foil 3 of tantalum or tungsten, about 3mm wide, which can be electrically heated to cause it to emit electrons. The tape or foil 3 is supported on a base 4 by supports, one of which is shown at 5, of tungsten. A cathode member 6 is formed with a rectangular slot to accommodate the tape or foil 3 and a plane guard element 7 is positioned on the cathode member and preferably just above the plane of the tape or foil 3. The guard element, inter alia, prevents electrons from the tape or foil 3 striking the electrode structure 2. The tape or foil 3, however, is constructed so that as few electrons as possible are emitted in directions other than normal to the tape or foil. To this end, in one example, the cathode is formed of rolled tantalum tape, the surface irregularities of which are less than 1 micron and preferably less than 0.1 microns. This is due to the fact that the cathode assembly is intended for use in an X-ray tube operated with an electric field gradient at the surface of the tape 3 of between 2 and 5 kV/mm. Under these conditions, small irregularities on the surface of the tape 3 will distort the field there, causing electrons to be emitted with considerable lateral energies. Electrons with high lateral energies (i.e. in excess of leV) tend to deteriorate the quality of the focussed electron beam. Thus it is arranged that electrons are emitted with lateral energies substantially below 0.2 electron volts (which is governed by the energy of free electrons within the tape prior to emission) by arranging that the surface finish of the tape is sufficiently smooth.

The electrode structure is spaced from the assembly 1 and has a plane surface 8 adjacent and facing towards assembly 1 and a rectangular aperture 9 to allow electrons from tape 3 to travel to an X-ray emissive anode, not shown. Preferably the surface 10 of the electrode 2, which faces away from assembly 1, is curved to conform to equipotentials naturally created between a cathode and an anode by an apertured electrode placed near the cathode and maintained at a few kilovolts positive to the cathode. As can be seen from the broken lines in FIG. 1, the cylindrical contour of surface 10 does not distort the equipotentials. The focussing field is thus uniform and the electrons from the source will pass through aperture 9 to be focussed by the uniform field to a well-defined beam 11 of rectangular form such as a line some 1 to 2mm wide at the anode (not shown) which is typically spaced by 100–200mm from the tape 3. The beam will also have a known intensity distribution across its width. This distribution may be of Gaussian form or other smooth variation from a low value at the edges to a single maximum at the centre. If the surface 10 is not curved but parallel to surface 8, the equipotentials are not unduly distorted and a focussing action is still obtained by the curvature of the equipotentials around the edge of the aperture 9.

The surface 8 is parallel to the surface of the guard element 7 and, in operation, there is a potential difference of some 3 kV across the space of some 1.5mm. As the surfaces are plane and parallel, the equipotentials of the electric field created over the source by the potential difference will be planar. This substantially prevents the occurrence of areas in which space-charge could accumulate. Furthermore, the field gradient is some 2 kV/mm between surface 8 and guard element 7 which gives a high and uniform field for the extraction of electrons from the surface of tape 3 and directs these electrons to the aperture 9. Electrons which, despite the precautions mentioned previously, are emitted from the tape 3 in directions other than normally thereto, are constrained against entering aperture 9 and the guard element 7 prevents electrons striking the edges of the focus electrodes to yield secondary electrons. In particular, by placing tape 3 just below guard element 7 as shown and operating the tape at a potential slightly less positive than the potential at which the element 7 is operated, the uniformity of the extraction field in the space above the tape is maintained. In all these ways the electrons entering the beam 11 are restricted so that those likely to cause aberrations are either not produced or rejected and even with emission densities of ½ to 1½ A/cm$^2$ from tape 3 a well defined electron beam 11 can be focussed at an anode by the uniform field which may be of some 4 kV/mm between electrode surface 10 and the anode.

When used for computerised tomography, an X-ray tube may have to be moved to scan the X-radiation relative to a body order examination. When using a tube as described above with elongated emitter such as tape 3, the emitter will be subject to various stresses, some due to movement of the tube.

FIG. 2 shows a side elevation of a source assembly to reduce the effect of these stresses. The tape 3 is typically 20mm long, 3mm wide and 0.025 to 0.050mm thick and on two tungsten supports 12 and 13. Support 12 is welded to tape 3 and to a copper block 14 which is housed in a base 15 in a mica insulator 16. Support 13 is welded to tape 3 and to a copper block 17. The copper block 17 is so mounted in base 15 that it can pivot, along the length of tape 3, on a pivot pin 18. A bob weight 19 is attached to an extension 20 of the support 13. A tension spring 21 acts between the extension 20 and an anchorage 22 secured to base 15.

In operation, tape 3 is electrically heated whether the tube is at rest or moving. As the tape is heated to near melting point, the tape tends to sag due to thermal expansion and the tendency for the tape to creep is increased. Accordingly, spring 21 acts through the lever formed by pivotally mounted support 13 to take up the sag while not so stressing the tape as to cause creep and the consequent stretching of the tape which could lead to failure. When the tube is moved to scan the radiation relative to the body, it usually travels in a circle in a plane perpendicular to the plane of FIG. 2 about an axis remote from the tube in the direction of arrow A and indicated by line C. While the tube is travelling at steady speed in a circle the tape 3 is subject to a centrifugal force acting in the direction of arrow B. When the anode-cathode and other potentials are applied, X-rays are produced as a beam directed toward line C. The operating potentials create electrostatic forces which, together with the forces due to rotation, could deflect the tape from its desired position relative to guard element 7 and electrode 2 despite the effect of spring 21. Such deflection would impair the quality of the focussed electron beam by altering the action of the equipotentials. Accordingly, the bob weight 19 is provided which, under the action of the force in direction B, maintains sufficient tension in the tape to substantially prevent such deflection. Clearly the tension must not be such as to cause creep in the tape. When X-rays are not required, the operating potentials are removed, leaving only the current heating the tape, and the tube brought to rest.

Electrode 2 can be used in focussing the electron beam on the anode and to control its intensity by cutting off emission from the source. For the above specific values a potential of some 3kV negative to the cathode is applied to electrode 2.

Other material suitable for vacuum use can be used for the source structure. Also other lever linkages can be used to permit the tension of the tape or other filament under other types and directions of tube movement.

The tape 3 used as the filament is representative only of a class of plate-like members, i.e. members having large surface area and thin edges which are suitable for use in a tube in accordance with the invention. The filament member need not, moreover, be flat, but could instead be dished, i.e. formed as a curved trough, provided that the aforementioned constraints are placed upon the surface finish of the filament. Instead of rolled tantalum, a solid sheet of $LaB_6$ would be suitable for use as an electron emitter having the required degree of surface finish, as would a sintered matrix of finely divided metal crystals, where the crystallite size is of the order of 0.1 microns, as used in dispenser cathode.

Turning now to FIG. 3, this shows three views of a cathode structure which has been constructed for use in an X-ray tube in accordance with an example of the invention. It will be observed that there are some differences of detail with regard to the cathodes shown in FIGS. 1 and 2, particularly with regard to the manner of applying spring loading to the electron emitting tape. Such differences serve to indicate that the invention is not limited to any particular structure.

FIG. 3 is in three parts, designated 3(*a*), 3(*b*) and 3(*c*), respectively and components therein which are common to one another and/or to FIGS. 1 and 2 are identified by the same reference numbers in each case.

FIG. 3(*a*) shows an exploded view of some components of the cathode structure 1. An apertured ceramic base member 23 contains support pillars 24 and 25 for the tantalum tape 3 and further pillars 26 and 27 for spring members which are not shown in FIG. 3(*a*) but which are provided to maintain the tape 3 under tension so as to overcome problems due to sagging of the tape when it is heated. The member 6, which acts as a suppression grid, is secured directly to the base 23 and has a trough 28 formed therein in which the tape 3 (which is not shown in FIG. 3(*a*)) is disposed without, however, contacting the member 6. The apertured guard element 7 and the assembly 2 are also shown.

FIG. 3(*b*) shows the base 23 and some of its attachments in more detail. The tape 3 can be seen, disposed in the trough 28 in the suppression grid 6, and the spring members 21*a* and 21*b* are shown in their relative dispositions to the tape 3.

FIG. 3(*c*) shows an isometric view of the complete assembly 1, 2 and in this view the aperture 9 in the electrode 2 and the curvature of the surface 10 can clearly be seen.

Referring now to FIG. 4, the entire assembly 1, 2 is included in an electron gun 29 which is arranged to project electrons axially of an X-ray tube 30. The tube 30 is formed with a glass envelope 31 and contains a tungsten target 32 set in a copper anode 33. The tungsten target 32 emits X-rays in response to the impingement thereon of the electrons from the gun 29. As previously mentioned, the electrons are intended to impinge upon a line 34 about 1mm wide on the target 32. A drift tube 35, axially disposed in the tube 30 and projecting from the anode 33 towards the gun 29 is provided in known manner to reduce the potentials which have to be applied to the tube components in order to establish a given strength of electric field in the tube. A cooling system of known kind, generally indicated at 36, is provided to cool the target anode member 32, 33. Forced oil cooling is a convenient technique.

In order that the electron beam can be deflected across the target 32 in a direction substantially perpendicular to its length, as indicated by the arrows 37, 38, suitable scanning coils 39 are disposed around the tube 30 as shown. The deflection of the electron beam causes deflection of the X-radiation emitted from the target 32 as shown by the arrows 40.

It will be clear that great accuracy of assembly of the cathode structure 1, 2 is required for the production of X-ray tubes with consistent characteristics. FIG. 5 shows a form of construction which achieves this accuracy without excessive demands on skill or precision of manufacture.

A base 41 is provided by which the source assembly can be mounted in a tube envelope. Insulatingly supported on the base are two similar filament mounting blocks 42, only one of which is shown. Each block has grooves to retain a filament mounting and tensioning member 43 and a slot 44 to constrain a filament tape 45 against lateral movement. Members 43 are resilient and are welded to the tape 45. A channel-defining member 46 is also mounted on base 41. This channel-defining member may also be insulated from the base. The channel defined by member 47 is made so that the surfaces of the lips each side of the channel are flat and level.

In assembling the source assembly, the relative heights of the channel lips and the bottom of the slot 44 on each block 42 are adjusted, e.g. by shims 47 on the base, so that the lips protrude sufficiently above the filament tape 45 whereby the lips form the guard element 6 spaced by gap 48 from the filament tape.

It will be seen that when the filament tape 45 is tensioned between the blocks 42 the plane of the tape is defined by the levels of the bottom of the slots 44 and is determined during construction by the use of jigs to assess the correct degree of shimming required. In one embodiment, with the potential mentioned above, the gap 48, that is the distance by which the lips of the channel protrude above the tape surface, can be adjusted to be 0.1mm within a tolerance of 0.01mm which accuracy permits operation at the desirably low potential.

The filament is heated by passing current to it through the metal-to-metal contact at the slots 44. In this way the resilient members 43 are not unduly heated and retain their resilience, keeping the heated filament in tension. The filament, when heated in this way, emits over the surface of the tape apart from areas within about 1mm of the blocks 42, which areas thus define the emitting length. A filament of a tape 3mm wide and 0.05mm thick operates at about 2300° K. as a high intensity source. The channel-defining member 46 can extend for the whole of the emitting length of the filament. The depth of the channel is chosen so that the field gradient to the underside of the filament prevents space charge build-up and collects electrons emitted from the underside of the filament for discharge as described.

As the emitting length of the filament is clearly defined, the electrode 2 can have an aperture in the form of a slit extending over the filament and having a length to coincide with the position of the slots in the mounting blocks. No screening electrodes are required at the ends of the aperture as the filament itself defines the emitting length. A substantially cylindrical lens is thus formed over the whole emitting length of the filament without the use of extra electrodes.

It has been found possible to reduce emission of electrons from the reverse of the tape by coating the back of the tape with a metal of a higher work function than the tape material e.g. tungsten for the tantalum tape. Clearly the coating must last as long as the tape and a tungsten thickness of 0.055mm should be adequate at 2300° K. operation. This coating will reduce emission to about 20% of the uncoated value.

The coating may be applied by evaporation, chemical or electrochemical deposition or as a thin foil welded on.

The reduction of the emission from the back of the filament clearly reduces the risk of stray electrons upsetting the focussed beam structure and also reduces the power required to maintain the guard element potential.

What I claim is:

1. An X-ray tube having a cathode comprising a plate member formed so that irregularities in the electron-emitting surface thereof do not exceed one micron in amplitude, means for generating an extraction field for withdrawing electrons from said member in substantially a single direction, an X-ray emissive target member, and means for focussing said electrons on a region of said target member which is of area substantially less than the area of said plate member.

2. A tube according to claim 1 wherein said plate member comprises a tape formed of rolled tantalum.

3. A tube according to claim 2 including resilient means for maintaining said tape under tension.

4. A tube according to claim 1 including a suppression structure formed with an open channel dimensioned to accommodate said plate member, the channel having lips which protrude above said plate member in a direction toward the target member.

5. A tube according to claim 1 including an apertured focussing electrode spaced from said plate member and positioned so that said electrons pass through the aperture thereof, the said focussing electrode being formed with a substantially planar surface facing said plate member.

6. A tube according to claim 5 wherein said focussing electrode is formed with a curved surface facing away from said member.

7. A tube according to claim 5 including an apertured guard member interposed between said plate member and said focussing electrode.

8. A tube according to claim 1 including means for deflecting said electrons relative to said target member.

9. A tube according to claim 8 wherein said deflecting means includes deflection coils.

10. A tube according to claim 1 wherein said electrons are constrained to travel to said target member as a beam which impinges upon a region of said target member about 1mm in width.

11. A tube according to claim 10 including a drift tube and means for constraining said beam to pass through said drift tube on its way to said target.

12. A tube according to claim 1 wherein the focussing means include means for focussing said electrons to a beam impinging on an elongated area of said target member, and including means for deflecting said beam to selectively move said elongated area relative to the target member along a direction transverse to the length of said elongated area.

13. A tube according to claim 1 wherein said plate member is flat.

* * * * *